US010196163B2

(12) United States Patent
Baltes et al.

(10) Patent No.: US 10,196,163 B2
(45) Date of Patent: Feb. 5, 2019

(54) FILLING MACHINE FOR FILLING PACKAGING CONTAINERS WITH PRODUCTS, AND METHOD THEREFOR

(71) Applicant: ELOPAK SYSTEMS AG, Glattbrugg (CH)

(72) Inventors: Klaus Baltes, Bergheim (DE); Thomas Boehme, Dresden (DE)

(73) Assignee: ELOPAK SYSTEMS AG, Glattbrugg (CH)

( * ) Notice: Subject to any disclaimer, the term of this patent is extended or adjusted under 35 U.S.C. 154(b) by 574 days.

(21) Appl. No.: 14/351,096

(22) PCT Filed: Oct. 5, 2012

(86) PCT No.: PCT/EP2012/069717
§ 371 (c)(1),
(2) Date: Apr. 10, 2014

(87) PCT Pub. No.: WO2013/053646
PCT Pub. Date: Apr. 18, 2013

(65) Prior Publication Data

US 2014/0260119 A1 Sep. 18, 2014

(30) Foreign Application Priority Data

Oct. 10, 2011 (DE) ..... 10 2011 054 327

(51) Int. Cl.

| | |
|---|---|
| ***B65B 43/28*** | (2006.01) |
| ***B65B 43/12*** | (2006.01) |
| *B65B 3/02* | (2006.01) |
| *B31B 50/80* | (2017.01) |

(52) U.S. Cl.
CPC ..... *B65B 43/126* (2013.01); *B65B 43/285* (2013.01); *B31B 50/80* (2017.08); *B65B 3/025* (2013.01)

(58) Field of Classification Search
CPC ..... B31B 1/00; B31B 2201/287; B31B 1/32; B65B 3/025; B65B 43/126; B65B 43/285
USPC ..... 493/309
See application file for complete search history.

(56) References Cited

U.S. PATENT DOCUMENTS 2,699,712 A * 1/1955 Meyer-Jagenberg ..... B31B 1/00 493/310
2,887,021 A * 5/1959 Duffy ..... 493/313
3,991,660 A * 11/1976 Calvert ..... B65B 43/285 493/310

(Continued)

FOREIGN PATENT DOCUMENTS

EP 0 490 458 A1 6/1992
EP 0 603 977 A1 6/1994

*Primary Examiner* — Alexander M Valvis
*Assistant Examiner* — Lucas E. A. Palmer
(74) *Attorney, Agent, or Firm* — Lucas & Mercanti, LLP

(57) ABSTRACT

A filling machine for filling packaging containers made of cardboard composite material with products, in particular liquid foods, includes a gripper that removes a packaging jacket from a magazine only partially erected in the manner of a parallelogram by a guide and at least one of two retaining elements for accommodating an outer fold edge of the partially erected packaging jacket can be move back and forth between an initial position and an end position. The cross-section of the packaging jacket accommodated by the two retaining elements is rectangular in the end position of the movable retaining element.

18 Claims, 4 Drawing Sheets

(56) References Cited

U.S. PATENT DOCUMENTS 3,996,843 A * 12/1976 Vogel ..... B65B 43/185 493/309
4,213,285 A * 7/1980 Mancini ..... B65B 51/067 156/522
4,285,679 A * 8/1981 Wahle ..... B31B 1/06 493/125
4,493,687 A * 1/1985 Bernle ..... B31B 1/80 493/310
4,531,931 A * 7/1985 Dietrich ..... B31B 1/06 493/309
4,632,666 A * 12/1986 Ulrich ..... B31B 1/06 493/183
4,708,707 A * 11/1987 Koike ..... B31B 1/00 271/165
4,892,513 A * 1/1990 Kwiek ..... B31B 5/80 493/123
5,027,586 A * 7/1991 Ramaker ..... B65B 43/285 493/316
5,112,288 A * 5/1992 Ulrich ..... B31B 5/80 493/183
5,162,033 A * 11/1992 Wakabayashi ..... B65B 43/285 493/122
5,180,356 A * 1/1993 Wakabayashi ..... B31B 5/80 493/125
5,484,377 A * 1/1996 Ueda ..... B65B 43/285 493/313
5,536,231 A * 7/1996 Nilsson ..... B31B 1/00 493/312
6,929,593 B1 * 8/2005 Chen ..... 493/123
7,422,551 B2 * 9/2008 Monti ..... B65B 43/265 493/309
8,075,467 B2 * 12/2011 Monti ..... B31B 1/80 493/177
8,602,956 B2 * 12/2013 Monti ..... B65B 43/325 493/309
2004/0138039 A1 * 7/2004 Mazurek ..... B31B 5/80 493/309
2006/0100081 A1 * 5/2006 Makar ..... 493/309
2007/0072756 A1 * 3/2007 Monti ..... B65B 5/024 493/309
2007/0082799 A1 * 4/2007 Makar ..... 493/309
2009/0093355 A1 * 4/2009 Huang ..... B65B 43/265 493/309
2009/0239726 A1 * 9/2009 Huang ..... B31B 1/06 493/309
2012/0122646 A1 * 5/2012 Murano ..... B65B 43/305 493/309
2015/0068163 A1 * 3/2015 Baltes ..... B31B 1/78 53/492

* cited by examiner

FILLING MACHINE FOR FILLING PACKAGING CONTAINERS WITH PRODUCTS, AND METHOD THEREFOR

CROSS-REFERENCE TO RELATED APPLICATIONS

This application is a 371 of PCT/EP2012/069717 filed Oct. 5, 2012, which in turn claims the priority of DE 10 2011 054 327.9 filed Oct. 10, 2011, the priority of both applications is hereby claimed and both applications are incorporated by reference herein.

BACKGROUND OF THE INVENTION

Filling machines for filling packaging containers made of cardboard composite material with products, in particular liquid foods, are known from the prior art. For example, reference is made to EP 0 936 992 B1 and DE 41 42 167 C2 for the construction of known filling machines.

The conventionally cuboid packaging containers are only made once they are in the filling machine, from packaging blanks which are provided with fold edges and welded together to form packaging jackets, because this improves transportability. Each packaging jacket that is folded flat has four packaging walls, which are separated from one another by parallel outer and inner fold edges. An acute internal angle is formed in each case between the packaging walls at the outer fold edges of the packaging jacket when it is folded flat. The inner fold edges of the folded-flat packaging jacket are arranged between the outer fold edges. An obtuse internal angle is formed in each case between the packaging walls at the inner fold edges of the packaging jacket when it is folded flat. If the packaging walls have mutually similar dimensions, the inner fold edges divide in half the length between the outer fold edges.

The folded-flat packaging jackets are supplied from a magazine to the at least one conveying line of the filling machine. In the magazine, the packaging jackets are arranged as a stack, conventionally standing upright, one behind the other. On a removal side of the magazine which points in the direction of the conveying line, two of the four packaging walls of the packaging jacket which is respectively at the front are exposed. A force, for example from a spring or a linear drive, acts on the stack at its rear side and in the direction of the removal side, in order to shift the packaging jackets of the stack toward the removal side.

A removal and unfolding device includes a gripper for taking hold of one of the two packaging walls that is exposed at the removal side of the magazine, a guide for the other of the two exposed packaging walls, and holding elements, arranged behind the guide as seen in the direction of motion, for receiving the outer fold edges of the unfolded packaging jacket.

The removal and unfolding device unfolds the initially folded-flat packaging jacket to form a packaging jacket which, as seen in cross section, forms a rectangle. The unfolded packaging jacket is transferred to a transport means. As they pass along the conveying line of the filling machine, the packaging containers which are made from the packaging jackets are sterilized, filled and then sealed. Conventionally, the packaging base is made directly before filling. Then, conventionally the packaging top is made.

As the transport means there are used in particular transport wheels or circulating conveyor belts having pocket-shaped receivers for the unfolded packaging jackets or packaging containers. The transport wheels, which rotate stepwise, have a plurality of radially outwardly extending parallel receivers. The receivers conventionally take the form of mandrels onto which the unfolded packaging jackets or packaging containers are pushed; this unit is then called a mandrel wheel. In another construction of a transport wheel of this kind, each receiver includes a plurality of arms or profiles which abut against the outside of the unfolded packaging jacket or packaging container, in particular directly next to the fold edges. In this case the receivers form cells into which the unfolded packaging jackets or packaging containers may be pushed; this unit is then also called a cell wheel.

A filling machine that is part of the prior art and has a removal and unfolding device, from SIG Combibloc GmbH in 52441 Linnich in Germany, will be explained in more detail below with reference to FIGS. 1 *a*-1 *d:*

The packing jackets (1), which are folded flat, are stored in the magazine (2) of the filling machine. Each folded-flat packaging jacket (1) has four packaging walls (5*a*, 5*b*, 6*a*, 6*b*) which are separated from one another by parallel outer fold edges (3*a*, 3*b*) and inner fold edges (4*a*, 4*b*).

The two forwardly pointing packaging walls (5*a*, 5*b*) of the respectively front packaging jacket (1) are exposed at a removal side (7) of the magazine (2). So that the packaging jackets (1) do not fall out of the magazine at the removal side (7), retaining elements (8*a*, 8*b*) are arranged at the removal side (7) and extend along the outer fold edges (3*a*, 3*b*) of the front packaging jacket (1). The respectively front packaging jacket (1) is not removed across the full width of the two packaging walls (5*a*, 5*b*). Rather, the packaging jacket (1) is only taken hold of at one of the two exposed packaging walls (5*a*) of the packaging jacket (1), at the removal side (7) of the magazine (2) (cf. FIG. 1 *a*). A suction gripper (9) which is secured to a pivotal arm (11) arranged to pivot about an axis (10) serves to take hold of the packaging wall (5*a*). As a result of a pivotal movement of the suction gripper (9) about the perpendicular axis (10), first the outer fold edge (3*a*) is freed from the retaining element (8*a*), wherein as the pivotal movement of the suction gripper (9) continues about the opposite outer fold edge (3*b*), which is still held by the retaining element (8*b*), a flat parallelogram is formed, as can be seen in particular from FIG. 1*a*. In the course of the further pivotal movement, first the outer fold edge (3*b*) is freed from the retaining element (8*b*). Then, the packaging jacket (1) is guided by means of the other of the two exposed packaging walls (5*b*) sliding along a curved guide surface (12) of a guide element (13). As the packaging jacket (1) moves along the path of motion (14), the guide surface (12) has the effect of making the acute internal angles (15*a*, 15*b*) larger, wherein the internal angle (15*a*) is formed between the packaging walls (5*b*, 6*b*) and the internal angle (15*b*) is formed between the packaging walls (5*a*, 6*a*). As seen in the direction of the path of motion (14), at the end of the curved guide surface (12) there is a holding element (16) which takes the form of a groove-shaped depression made in the guide element (13). The holding element (16) serves to receive the outer fold edge (3*b*) of the unfolded packaging jacket (1). Also as seen in the direction of the path of motion (14), downstream of the guide surface (12) there is a further stationary holding element (17) in the form of a holding strip (17) for receiving the diametrically opposed outer fold edge (3*a*). The holding elements (16, 17) are spaced and aligned such that the packaging jacket received by the holding elements (16, 17) forms a rectangle as seen in cross section. This alignment is required for unproblematic transfer of the unfolded packaging jacket to the transport means downstream of the removal and unfolding device, such as in particular the transport wheels mentioned at the outset. At the end of the curved guide surface (12), the initially acute internal angle (15*a*, 15*b*) of the packaging jacket briefly becomes slightly greater than 90°, as can be seen from FIG. 1*c*, in order to ensure that the fold edge (3*b*) latches unproblematicaliy into place in the holding element (16).

The fold edges (3*a*, 3*b*, 4*a*, 4*b*), in particular the inner fold edges (4*a*, 4*b*) of the packaging jacket (1), create restoring moments which act in opposition to unfolding of the packaging jacket (1). As the packaging jacket (1), which is initially folded flat, unfolds to form a packaging jacket which is rectangular as seen in cross section, the restoring moments increase. As can be seen in particular from FIG. 1*b*, the line of contact between the packaging wall (5*b*), which is guided in sliding manner, and the guide surface (12) extends approximately in the centre of the packaging wall, parallel to the fold edges (3*b*, 4*a*) that delimit the packaging wall (5*b*). Because the restoring moments increase as unfolding continues along the path of motion (14), increasing contact pressure forces between the packaging wall (5*b*) and the guide surface (12) are also produced. The powerful contact pressure force, increasing along the path of motion, requires a powerful suction force from the suction gripper (9) in order to hold the packaging jacket (1) securely during the removal and unfolding movement. Because a high throughput rate is required of filling machines during filling of the packaging containers, removal and unfolding of the packaging jackets must be carried out at a correspondingly high speed. This has the result that the packaging jackets (1) are drawn along the guide surface (12) and into the holding elements (16, 17) at high speed, which because of the unavoidable latching of the packaging jacket into place in the holding element (16) results in the development of considerable noise. Finally, relatively powerful transverse forces, both during latching of the packaging jacket into place in the holding element (16) and during the unfolding movement along the guide surface (12), are produced between the suction elements of the suction gripper (9) and the packaging wall (5*a*). If the holding forces of the suction gripper are exceeded during this, the packaging jacket that is taken hold of may be unintentionally released and hence operation of the entire filling machine may be disrupted. Moreover, the powerful contact pressure forces between the guided packaging wall and the guide may cause abrasion marks on the packaging wall.

EP 0 766 621 B1 discloses a device for removing a packaging jacket from a magazine and for unfolding the packaging jacket to give a rectangular cross section, wherein a gripper that is arranged to pivot about an axis of rotation takes hold of one of the two exposed packaging walls of the folded-flat packaging jacket at the removal side of the magazine. Moreover, the device has a guide that is arranged to pivot about an axis and takes the form of a flap which is pivotal by means of a drive from a first position into a second position. Further, the device has a stationary holding element for receiving one of the two outer fold edges of the packaging jacket, which has not yet been completely unfolded. However, the opposite fold edge is not taken hold of by a holding element. Rather, the packaging wall that is not taken hold of by the gripper abuts flush against the pivotal flap.

Pivoting the flap clockwise about the axis has the effect of completely erecting the packaging jacket, with the result that the cross section of the packaging jacket is rectangular. During this, the packaging wall that abuts against the pivotal flap slides along the flap until, in the end position of the pivotal flap, a lug that is arranged on the end of the flap receives the second outer fold edge. The suction gripper can only be released once the packaging jacket has been completely erected to give a rectangular cross section, since otherwise the restoring forces of the packaging jacket would cause it to slide out of the device. A further disadvantage of the device consists in the fact that, in the phase when the restoring forces are greatest, that is to say when the packaging jacket is completely erected, the packaging jacket abuts flush against the flap and performs a motion in relation thereto, as a result of which a relatively high level of wear and damage to the packaging wall may result.

BRIEF SUMMARY OF THE INVENTION

Taking this prior art as a starting point, the object of the invention is to provide a filling machine of the type mentioned at the outset which requires less powerful holding forces for removing and unfolding the packaging jackets, in which disruptions to operation and abrasion marks on the guided packaging wall are avoided, and in which the development of noise is reduced. Further, the object of the invention is to propose a corresponding method for removing and unfolding packaging jackets from a magazine of a filling machine of this kind.

This object is achieved in the case of a filling machine in that

- the guide is set up such that it increases the internal angles to an amount of less than 90°,
- at least one of the two holding elements is arranged such that it may be moved to and fro between an initial position and an end position, and
- the holding elements are arranged such that, following the increase in the internal angles by the guide, they receive the outer fold edges of the packaging jacket, which has not yet been completely unfolded and as seen in cross section forms a parallelogram, and by means of a subsequent motion of at least one of the two holding elements between the initial position and the end position they completely unfold the packaging jacket, with the result that the cross section of the packaging jacket is rectangular.

Furthermore, the object is achieved by a method using the above-described filling machine.

Because the restoring forces of the packaging jacket increase as the acute internal angle becomes larger, limiting the amount of the internal angle effectively reduces the holding forces of the gripper. The guide is set up such that it increases the internal angles to an amount of less than 90°. The maximum increase in the internal angle may for example be determined by the angle between a guide surface of the guide and the path of motion of the gripper, and by the length of the guide surface.

Transfer of the packaging jacket from the guide to the holding elements is performed with the same packaging jackets and with a restoring force that is reduced by comparison with the prior art, as a result of which the noise during latching into place in the holding elements is also reduced. The holding elements are arranged such that, following the increase in the internal angles by the guide, they receive the outer fold edges of the packaging jacket, which has not yet been completely unfolded and as seen in cross section forms a parallelogram. For this purpose, the holding elements may be arranged downstream of the guide or a guide surface of the guide, as seen in the direction of the path of motion of the gripper.

The holding elements for receiving the outer fold edges are preferably arranged downstream of the guide, as seen in the direction of motion of the gripper during removal. One of the guide elements may also be a component of the guide at the end of a guide surface. However, the holding elements are not arranged on the gripper or the downstream transport means, since this would lengthen the work cycle of removal and erecting.

With the aid of the at least one holding element that may be moved to and fro between an initial position and an end position, the internal angle is subsequently increased to 90°, with the result that, in the end position of the holding element or elements, the packaging jacket adopts the desired rectangular cross section and is completely unfolded.

The guide is preferably constructed such that, at least in an end region of the guide, in which the restoring forces are already increased sharply, only the outer fold edge is guided, rather than the packaging wall of the packaging jacket. Because of this, the guide and the packaging wall do not touch one another, at least in the end region of the guide, with the result that abrasion marks on the packaging wall, caused by powerful contact pressure forces in the final phase of motion along the guide, are reliably prevented. The forces that result from the restoring moments are only taken up by way of the guided fold edge, and consequently the holding forces of the gripper are further reduced.

It is advantageous from a constructional point of view if the holding element for receiving the guided outer fold edge is arranged to be movable to and fro between an initial position and an end position, and the holding element for receiving the diametrically opposing outer fold edge is arranged to be stationary.

Before the packaging jacket has formed the desired rectangular cross section, the leading fold edge of the packaging jacket reaches the stationary holding element, in particular a stationary holding strip. At the same time, the trailing fold edge of the packaging jacket which has not yet formed a rectangular parallelogram reaches the operating region of the holding element which is movable to and fro between an initial position and an end position. This movable holding element is at this point moved from the initial position into the end position until the desired rectangular cross section of the packaging jacket has been achieved.

The required length of the path of motion between the initial position and the end position of the holding element or elements depends on the extent to which the packaging jacket has already been unfolded at the end of the guide that is to say the angular amount by which the acute internal angles on the outer fold edges of the packaging jacket are smaller than 90 degrees at the end of the guide.

If the packaging jacket has been almost completely unfolded before the holding elements come into operation, this results in a short path of motion between the initial position and the end position of the holding element or elements. If the packaging jacket has been unfolded to a less complete extent before the holding elements come into operation, this results in a longer path of motion between the initial position and the end position of the holding element or elements. The longer path of motion reduces the holding forces of the gripper and the development of noise but has a disadvantageous effect on the duration of the procedure for unfolding the packaging jacket, while the shorter path of motion increases the holding forces of the gripper and the development of noise but makes the procedure shorter in duration.

Taking into account the relationship above, the guide in particular makes the acute internal angles larger by an amount in a range of 30°-80°, preferably in a range of 45°-60°.

Once the movable holding element is in the end position or the two movable holding elements are in the end position and the packaging jacket has the desired rectangular cross section, the latter is preferably transferred, by means of a lifting device or the gripper itself, to a transport means which is downstream as regards the conveying line, in particular being pushed onto the mandrel of a transport wheel.

A further reduction in the holding forces can be achieved in that the path of motion of the gripper is rectilinear and extends at a right angle to the exposed packaging wall of the packaging jacket at the removal side of the magazine, that is to say the packaging wall which the gripper takes hold of. The path of motion of the gripper which is aligned in this way reduces the holding forces of the latter, in particular the suction force of the gripper, which preferably takes the form of a suction gripper. Moreover, rectilinear guidance reduces the loads on the packaging jackets and wear on the suction elements of the gripper.

Continuous unfolding of the packaging jacket until it forms a non-rectangular parallelogram as seen in cross section is preferably achieved in that the guide includes a planar guide surface for sliding guidance of the outer packaging edge, and the spacing between the guide surface and the path of motion of the gripper from the removal side of the magazine in the direction of the holding elements for receiving the outer fold edges decreases continuously.

The packaging jacket is received at the outer fold edges reliably and in a manner that handles the material gently if each holding element has two surfaces which are arranged at an angle to one another and which abut against the surface of the packaging walls in the end position of the holding element(s) that is(are) movable to and fro. In this case, the corresponding holding forces are taken up not only at the fold edges but also in the adjoining portions of the packaging walls.

In a constructionally advantageous embodiment, each movable holding element takes the form in particular of an angled profile. As a drive for the holding strip that is movable to and fro, there serves a linear system including a lever having a linear guide and a servo motor. However, electromechanical linear drives are also a possibility.

If the spatial conditions in the filling machine necessitate a particularly compact overall construction, in an embodiment of the invention one of the two holding elements may be arranged on the guide. The holding element takes the form in particular of an integral component of the guide; for example, it may be made in one piece with the guide, as a milled or cast part.

Once at least one of the two holding elements is moved from the initial position into the end position, guidance of the packaging jacket along the guide comes to an end. For this reason, it is also possible for the holding element that is arranged on the guide to be constructed such that, together with the guide, it is movable to and fro between an initial position and an end position.

BRIEF DESCRIPTION OF THE DRAWINGS

The invention will be explained in more detail below with reference to the figures, in which.

DETAILED DESCRIPTION OF THE PREFERRED EMBODIMENTS

Figure 1A:
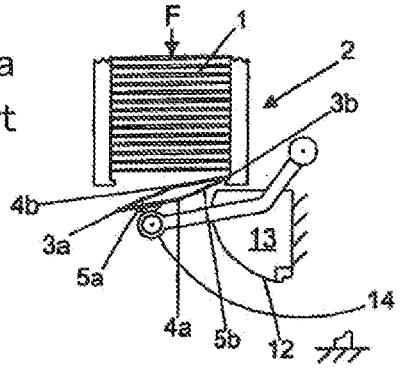
Figure 1a Prior Art
FIG. 1*a*-1*d* shows a series of views illustrating a method according to the prior art.
Figure 1B:
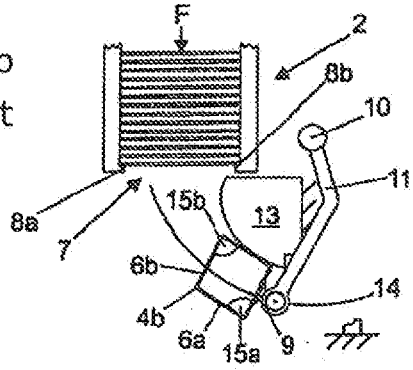
Figure 1b Prior Art
Figure 1C:
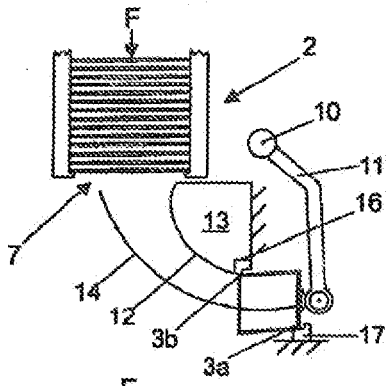
Figure 1c Prior Art
Figure 1D:
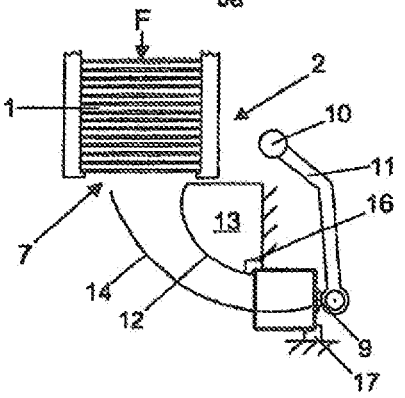
Figure 1d Prior Art

Where the filling machines according to the invention for filling packaging containers with liquid foods, which are partly illustrated in FIGS. 2-5, include components that correspond to the filling machine of the prior art that is partly illustrated in FIGS. 1*a*-1*d*, corresponding reference numerals are used. Moreover, for supplementary information explicit reference is made to the explanation of the filling machine illustrated in FIGS. 1*a*-1*d*.

On a frame (18) of the filling machine, at the input side of the conveying line, there is arranged the magazine (2) for receiving the folded-flat packaging jackets (1) for manufacturing the packaging containers. The magazine (2) includes holding profiles (19*a, b*) which abut against the outer fold edges (3*a, b*) of the packaging jackets (1). At the end sides of the free limbs of the holding profiles (19*a, b*) are the retaining elements (8*a, b*), which take the form of projections. The retaining elements (8*a, b*) prevent the upright stack of packaging jackets (1) which is received by the magazine (2) from falling out of the magazine (2) at the removal side (7).

The removal side (7) of the magazine (2) exposes the two front packaging walls (5*a, b*) of the, in total, four packaging walls (5*a, b*, 6*a, b*) of the respectively front packaging jacket (1). The removal and unfolding device which is downstream of the magazine (2), as seen along the conveying line of the filling machine, includes a suction gripper (9) having three pneumatic suction elements for taking hold of the packaging wall (5*a*) which is exposed at the removal side (7). The suction gripper (9) is secured to an actuator (20) that is arranged such that it may be shifted along a rectilinear path of motion (21) perpendicular to the exposed packaging wall (5*a*) of the packaging jacket (1). The shifting motion is performed using a linear system.

The removal and unfolding device moreover has a planar guide surface (23) as a guide for the outer fold edge (3*b*), (see FIGS. 4*a*-4*d*) of the other of the two exposed packaging walls (5*b*) of the packaging jacket. The planar guide surface (23) serves to guide the outer fold edge (3*b*) in sliding manner.

Downstream of the planar guide surface (23), as seen in the direction of the path of motion (21), there is a stationary holding element (17) for receiving the outer fold edge (3*a*). The holding element (24) for receiving the diametrically opposed outer fold edge (3*b*) is movable to and fro by means of a linear drive, between an initial position, illustrated in FIGS. 4 *a-c*, and an end position illustrated in FIG. 4 *d*. Both the stationary holding element (17) and the movable holding element (24) take the form of an angled profile. The two surfaces of the angled profile which are arranged at an angle to one another abut against the packaging walls (5*a*, 6*a* and 5*b*, 6*b*) in the end position, illustrated in FIG. 4 *d*.

As can be seen in particular from FIGS. 4 *a-d*, the spacing between the planar guide surface (23) and the path of motion (21) of the suction gripper (9) diminishes continuously from the removal side (7) of the magazine (2) in the direction of the holding elements (17, 24).

In order to transfer the packaging jacket (1), which is held completely erect by the holding elements (17, 24), to a transport means (22) of the filling machine, downstream of the removal and unfolding device, a jacket pushing means (28) which may be moved vertically up and down by means of a circulating belt (30) is provided.

The transport means (22) includes a transport wheel (26) which is rotatable about an axis (25) and has four radially outwardly extending parallel receivers, each of which has a plurality of profiles (27) that abut against the inner fold edge (4*a*) and the packaging walls (6*a, b*). The profiles (27) form cells into which the unfolded packaging jackets (1) of rectangular cross section may be pushed by the actuator (20). The axis of rotation (25) of the transport wheel (26) extends in a horizontal plane, transversely to the conveying line (21) of the filling machine. The transport wheel (26) is rotated stepwise about the axis of rotation (25) of the transport wheel (26) by a drive (not illustrated), in each case by 90 degrees. The unfolded packaging jackets are transferred from the illustrated transport wheel (26) to further transport means (not illustrated in the figures) in order to perform operational steps on the packaging jackets (1) for the manufacture of the packaging container.

Figure 2:
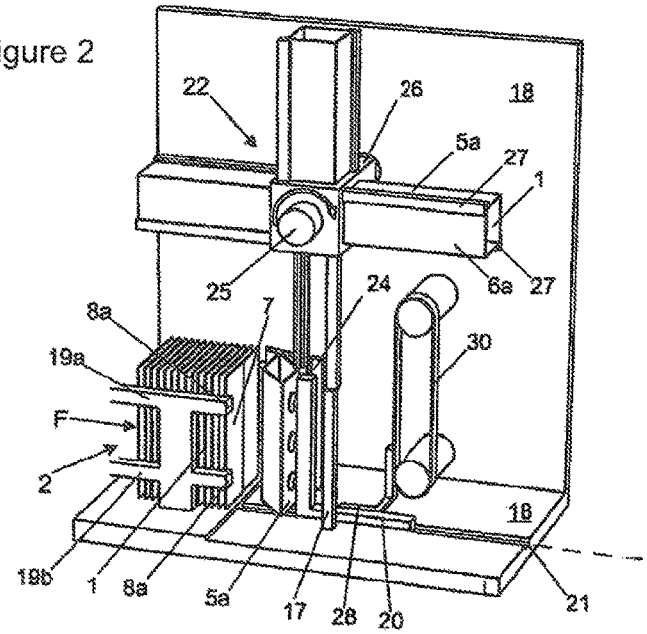
FIG. 2 shows a schematic perspective partial view of a filling machine in the region of the removal and unfolding device, during removal of a folded-flat packaging jacket from a magazine.
Figure 3:
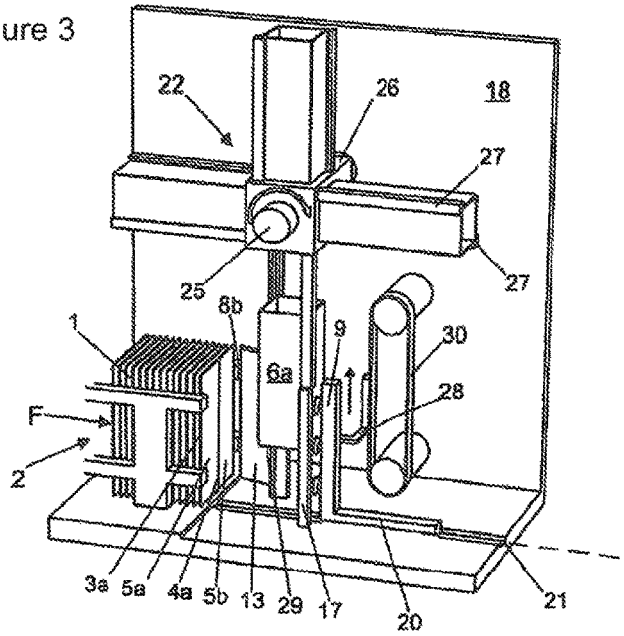
FIG. 3 shows a partial view of the filling machine according to FIG. 2, during transfer of the unfolded packaging jacket to a transport wheel that is arranged downstream, as seen along the conveying line.
Figure 3A:
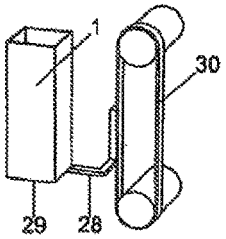
FIG. 3*a* shows a detail view of a jacket pushing means of a filling machine according to FIGS. 2 and 3, FIGS. 4 *a-d* show a series of schematic views illustrating the method for removing and unfolding packaging jackets from a magazine of a filling machine according to FIGS. 2 and 3, and FIGS. 5 *a-e* show a series of schematic views illustrating the method for removing and unfolding packaging jackets from a magazine of a second exemplary embodiment of a filling machine according to the invention.

The magazine (2) of the partly illustrated filling machine according to FIG. 5 corresponds to the magazine (2) of the filling machine according to FIGS. 2 to 4, so reference is made to the explanations there.

The removal side (7) of the magazine (2) exposes the two front packaging walls (5*a, b*) of the, in total, four packaging walls (5*a, b*, 6*a, b*) of the respectively front packaging jacket (1). The removal and unfolding device, which as seen on the conveying line of the filling machine is downstream of the magazine (2), includes a suction gripper (9) having three pneumatic suction elements for taking hold of the packaging wall (5*a*) which is exposed at the removal side (7). The suction gripper (9) is secured to an actuator (20) that is arranged such that it may be shifted along a rectilinear path of motion (21) perpendicular to the exposed packaging wall (5*a*) of the packaging jacket (1). The shifting motion is performed using a conventional linear drive, in particular a pneumatic cylinder.

The removal and unfolding device moreover has a curved guide surface (23) as a guide for the other of the two exposed packaging walls (5*b*) of the packaging jacket (1). The curved guide surface (23) serves to guide first the packaging wall (5*b*) (cf. FIG. 5 *b*) and then (cf. FIG. 5 *c*) the outer fold edge (3*b*) in sliding manner. The transfer to the fold edge guide has the effect that, at least in an end portion of the guide surface (23), in which the restoring forces caused by the packaging jacket (1) have already increased sharply, only the outer fold edge (3*b*) is guided, rather than the packaging wall (5*b*) of the packaging jacket (1). Thus, the guide surface (23) and the packaging wall (5*b*) do not touch one another, at least in the end portion, with the result that abrasion marks on the packaging wall (5*b*) as a result of powerful contact pressure forces in the final phase of motion along the guide surface (23) are reliably avoided. At the same time, the holding forces of the suction gripper (9) are further reduced during the critical final phase of the unfolding motion by the guide.

Downstream of the curved guide surface (23), as seen in the direction of the path of motion (21), in this embodiment of the invention too there is a stationary holding element (17) for receiving the outer fold edge (3*a*) (cf. FIG. 5 *d*). The stationary holding element (17) takes the form of an angled profile. In this embodiment, the holding element (24) for receiving the diametrically opposed outer fold edge (3*b*) is arranged on the guide itself. The holding element (24) has two surfaces which are arranged at a right angle to one another and which, as an integral component of the guide element (13), spring back in relation to the curved guide surface (23) which is also arranged on the guide element (13).

The guide element (13) including the guide surface (23) and the holding element (24) is movable to and fro by means of a linear drive between the initial position, illustrated in FIGS. 5 *a-d*, and the end position illustrated in FIG. 5 *e*. The two surfaces of the integrated holding element (24) which are arranged at a right angle to one another abut against the packaging walls (5*b*, 6*b*) in the end position, illustrated in FIG. 5 *e*).

In order to transfer the packaging jacket (1), which is held completely erect by the holding elements (17, 24), to a transport means (22) of the filling machine, downstream of the removal and unfolding device, in this embodiment too a jacket pushing means (28) which may be moved vertically up and down by means of a circulating belt (30) is provided.

The transport means (22) is constructed in a manner corresponding to the illustration in FIGS. 2 to 4, so reference is made to the statements there.

The method for removing and unfolding the packaging jackets (1) from the magazine (2) of the filling machine will be explained below in more detail with reference to FIGS. 2-4:

First, the magazine (2) is filled with a stack of folded-flat packaging jackets (1), which in the exemplary embodiment illustrated stand upright. The magazine (2) exposes the two front packaging walls (5*a, b*) at the removal side (7) of the magazine (2), for the suction gripper (9) to take hold of them. The suction gripper (9) is moved by the actuator (20) in the direction of the removal side (7), into a front position of the path of motion (21), and takes hold of the exposed front packaging wall (5*a*) with the aid of the three suction elements of the suction gripper (9), by a negative pressure being generated pneumatically in the suction elements. Then, the suction gripper (9) is moved along the path of motion (21), out of the front position of the path of motion (21) in the direction of its rear position, with the aid of the actuator (20). During this, first the outer bend edge (3*a*) is freed from the retaining element (8*a*), while the outer bend edge (3*b*) is still retained at the removal side (7) by the retaining element (8*b*). During this, the packaging jacket opens in the manner of a parallelogram, as can also be seen in particular from the perspective illustration according to FIG. 2 and FIG. 4 *a*), As the packaging jacket (1) continues to move along the path of motion (21) with the aid of the suction gripper (9), the outer bend edge (3*b*) is also freed from the retaining element (8 *b*) and slides along the planar guide surface (23), as a result of which the acute internal angles (15*a, b*) between the packaging walls (5*b*, 6*b* and 5*a*, 6*a* respectively) continuously increase in size until these internal angles (15*a, b*) are around 50° at the end of the guide surface (23), in the exemplary embodiment illustrated (cf. FIG. 4 *c*).

At this time, the guided outer bend edge (3*b*) reaches the operating region of the movable holding element (24), which is still in the initial position (cf. FIG. 4 *c*). The diametrically opposed outer bend edge (3*a*) is at this time received in the stationary holding element (17). The cross section of the packaging jacket (1) received by the two holding elements (24, 17) forms a non-rectangular parallelogram.

Figure 4A:
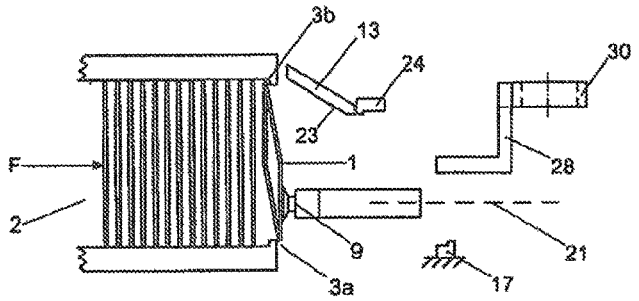
Figure 4B:
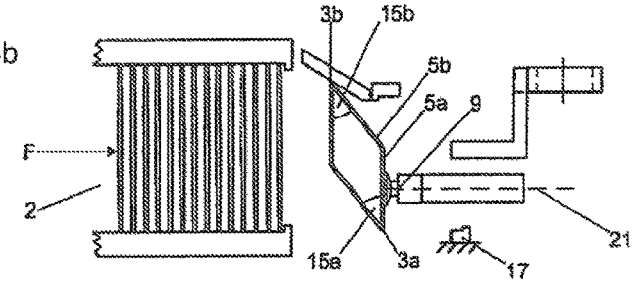
Figure 4C:
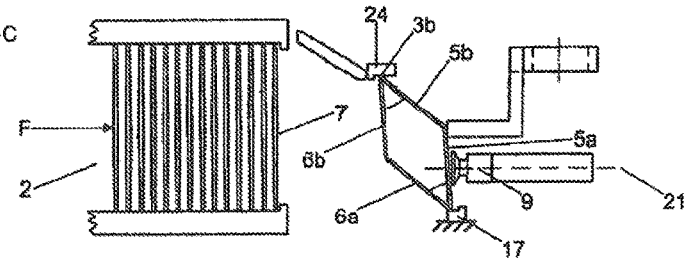
Figure 4D:
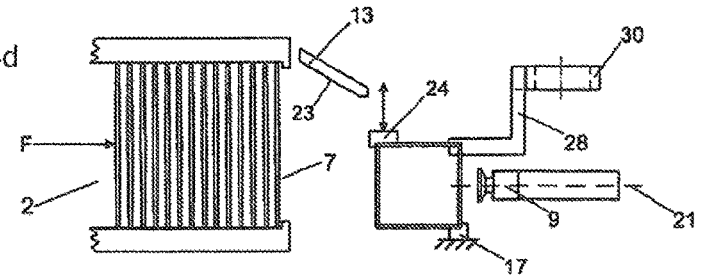
Figure 5A:
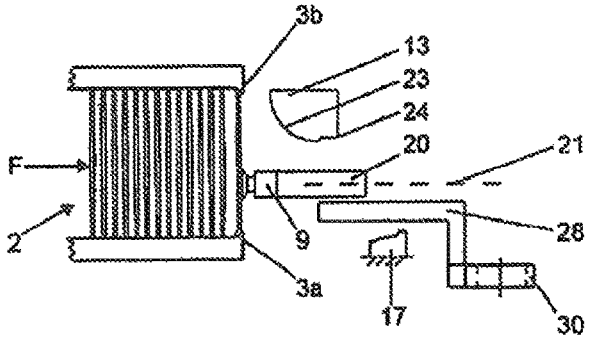
Figure 5B:
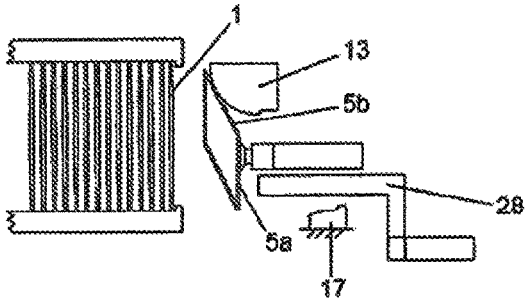
Figure 5C:
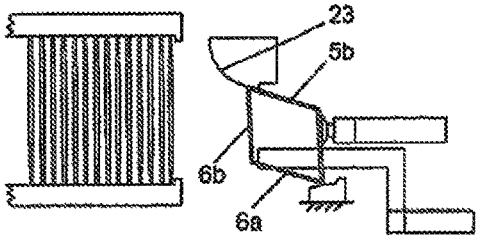
Figure 5D:
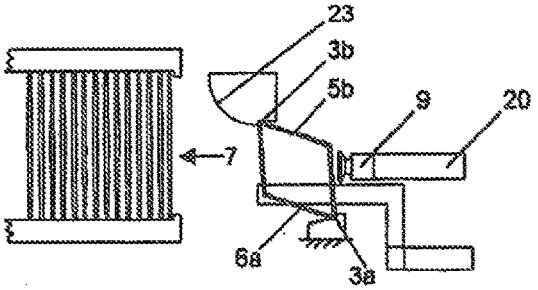
Figure 5E:
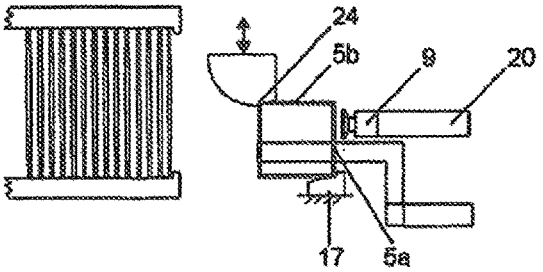

The movable holding element (24) is now moved out of the initial position (FIG. 4*c*) and into the end position illustrated in FIG. 4 *d*, wherein the cross section of the packaging jacket (1) received by the holding elements (17, 24) forms a rectangle as soon as the movable holding element (24) has adopted the end position (cf. FIG. 4*d*).

As soon as the movable holding element (24) has adopted the end position illustrated in FIG. 4 *d*, the two holding elements (17, 24) are located flush with one of the receivers of the transport wheel (26) that are formed by the profiles (27). The suction elements of the suction gripper (9) are switched off. The erected packaging jacket (1) can now be pushed onto the receiver with the aid of the jacket pushing means (28), which takes hold of the packaging jacket (1) at its lower edge (29). As soon as the packaging jacket (1) is located in the profiles (27) of the receiver, the suction gripper (9) moves in the direction of the stack front side again, toward the removal side (7) of the magazine (2), in order to take hold of the next packaging jacket (1). Meanwhile, the jacket pushing means (28) moves downward on the belt (30) in order to take hold of the next erected packaging jacket (1) at its lower edge (29) and to push it onto the receiver.

List of reference numerals

| No. | Item |
|---|---|
| 1 | Packaging jacket |
| 2 | Magazine |
| 3 a, b | Outer bend edges |
| 4 a, b | Inner bend edges |
| 5 a, b | Packaging walls |
| 6 a, b | Packaging walls |
| 7 | Removal side |
| 8 | Retaining elements |
| 9 | Suction gripper |
| 10 | Axis |
| 11 | Pivotal arm |
| 12 | Guide surface |
| 13 | Guide elements |
| 14 | Path of motion |
| 15 a, b | Internal angles |
| 16 | Holding element |
| 17 | Holding element |
| 18 | Frame |
| 19 a, b | Holding profiles |
| 20 | Actuator |
| 21 | Path of motion |
| 22 | Transport means |
| 23 | Planar guide surface |
| 24 | Holding element (movable) |
| 25 | Axis of rotation of transport wheel |
| 26 | Transport wheel |
| 27 | Profiles |
| 28 | Jacket pushing means |
| 29 | Lower edge |
| 30 | Belt |

The invention claimed is:

1. A filling machine for filling packaging containers with products, comprising a magazine for receiving folded-flat packaging jackets for manufacture of the packaging containers, wherein each folded-flat packaging jacket has four packaging walls which are separated from one another by respective parallel outer and inner fold edges, and an acute internal angle is formed in each case between the packaging walls at the outer fold edges, two of the four packaging walls of a first packaging jacket in the magazine are exposed at a removal side of the magazine;

a gripper for taking hold of one of the two exposed packaging walls of the first packaging jacket at the removal side of the magazine and for moving the first packaging jacket out of the magazine along a path of motion;

a guide arranged along the path of motion and guiding the first packaging jacket such that the internal angles, which are formed at the outer fold edges between the packaging walls, increase as the packaging jacket moves along the path of motion, the guide is configured such that the internal angles increase to an amount of less than 90° during movement of the first packaging jacket along the path of motion;

holding elements for receiving the outer fold edges of the first packaging jacket, at least one of the two holding elements being movable to and fro between an initial position and an end position, the holding elements being arranged downstream of the guide in a direction of the path of motion such that, after the movement by the gripper along the path of motion is complete, the holding elements receive the outer fold edges of the first packaging jacket, and a subsequent movement, without further movement of the gripper, of the at least one of the holding elements from the initial position to the end position after the outer fold edges of the first packaging jacket are received fully unfolds the first packaging jacket to a rectangular cross-section.

2. The filling machine as claimed in claim 1, wherein one of the two holding elements is movable to and fro between the initial position and the end position and receives a first guided outer fold edge, and the other holding element is stationary and receives a second guided fold edge that is diametrically opposed to the first outer fold edge.

3. The filling machine as claimed in claim 1, wherein in the initial position of the at least one of the holding elements that is movable to and fro, the cross section of the packaging jacket received by the two holding elements forms a non-rectangular parallelogram.

4. The filling machine as claimed in claim 1, wherein the path of motion of the gripper is rectilinear.

5. The filling machine as claimed in claim 4, wherein the path of motion of the gripper extends at a right angle to the exposed packaging wall at the removal side of the magazine.

6. The filling chine as claimed in claim 1, wherein the gripper is a suction gripper.

7. The filling machine as claimed in claim 1, wherein the guide includes a guide surface for guiding an outer packaging edge.

8. The filling machine as claimed in claim 7, wherein the guide surface is planar, and the spacing between the planar guide surface and the path of motion of the gripper decreases continuously in the direction from the removal side of the magazine to the holding elements for receiving the outer fold edges.

9. The filling machine as claimed in claim 1, wherein each holding element has two surfaces arranged at an angle to one another and which abut against the packaging walls in the end position of the at least one of the holding elements that is movable to and fro.

10. The filling machine as claimed in claim 9, wherein each of the holding elements has an angled profile.

11. The filling machine as claimed in claim 1, wherein a first holding element of the two holding elements is arranged on the guide.

12. The filling machine as claimed in claim 11, wherein the one of the holding elements that is movable to and fro from the initial position and the end position is the first element and the guide moves with the first element.

13. The filling machine as claimed in claim 1, wherein the guide and the holding elements are configured so that the guide does not contact the first packaging jacket during the subsequent movement of the at least one of the holding elements.

14. A method for removing and unfolding packaging jackets from a magazine of a filling machine for filling packaging containers with products, including the method steps of:

introducing folded-flat packaging jackets into the magazine, wherein each folded-flat packaging jacket has four packaging walls separated from one another by parallel outer and inner fold edges, and an acute internal angle is formed in each case between the packaging walls at the outer fold edges;

exposing two of the four packaging walls of a first packaging jacket at a removal side of the magazine;

taking hold of one of the two exposed packaging walls of the first packaging jacket by a gripper at the removal side of the magazine and moving the first packaging jacket along a path of motion;

guiding the packaging jacket along a guide causing the internal angles, which are formed at the outer fold edges between the packaging walls, to increase to an amount of less than 90° as the first packaging jacket moves along the path of motion, thereby forming an unfolded first packaging jacket;

receiving by holding elements, after the gripper has finished the movement along the path of motion and the increase of the internal angles by the guide to an amount of less than 90°, by holding elements the outer fold edges of the unfolded first packaging jacket, at least one of the holding element of the holding elements is movable to and fro between an initial position and an end position, at least one of the two outer fold edges is received in the initial position of the at least one of the holding element, wherein, in the initial position of the at least one holding element the internal angles are the amount of less than 90° such that the cross section of the unfolded first packaging jacket received by the holding elements forms a non-rectangular parallelogram; and moving the at least one holding element from the initial position into the end position, wherein the cross section of the unfolded first packaging jacket that is received by the holding elements forms a rectangle in the end position of the at least one holding element.

15. The method as claimed in claim 14, wherein the path of motion is a rectilinear path of motion and the first packaging jacket is moved along the rectilinear path of motion by the gripper.

16. The method as claimed in claim 15, wherein the gripper is moved at a right angle to the packaging wall of the first packaging jacket that is exposed at the removal side of the magazine and is taken hold of by the gripper.

17. The method as claimed in claim 14, wherein the guide surface is a planar guide surface and the step of guiding includes guiding one of the outer fold edges of the first packaging jacket in a sliding manner along the planar guide surface.

18. The method as claimed in claim 14, wherein the first packaging jacket does not contact the guide during the step of moving the at least one holding element.

* * * * *